US006352293B1

(12) United States Patent
Baschenis

(10) Patent No.: US 6,352,293 B1
(45) Date of Patent: Mar. 5, 2002

(54) CROSS-LOCK TWEEZERS WITH CUP TO HOLD PEARLS, OR THE LIKE

(76) Inventor: Bruno Baschenis, P.O Box 2572, Papeete, Tahiti (PF), 98713

( * ) Notice: Subject to any disclaimer, the term of this patent is extended or adjusted under 35 U.S.C. 154(b) by 0 days.

(21) Appl. No.: 09/675,755

(22) Filed: Sep. 29, 2000

(51) Int. Cl.[7] ..... B25B 9/02
(52) U.S. Cl. ..... 294/99.2; 294/902
(58) Field of Search ..... 294/7, 8, 8.5, 11, 294/33, 99.2, 104, 106, 902; 81/6, 7; 269/6; 606/207, 210; D7/686

(56) References Cited

U.S. PATENT DOCUMENTS

| | | | | | |
|---|---|---|---|---|---|
| 201,404 | A | * | 3/1878 | George | 294/99.2 |
| 1,033,942 | A | | 7/1912 | Ruggles | |
| 1,174,004 | A | | 2/1916 | Greenwald | |
| 1,269,321 | A | * | 6/1918 | Schwarz | 294/99.2 |
| 1,481,598 | A | | 1/1924 | Gatti | |
| 1,545,693 | A | * | 7/1925 | Phoel | 294/99.2 |
| 1,767,175 | A | * | 6/1930 | Glass | 294/99.2 |
| 2,010,074 | A | * | 8/1935 | Fuerst | 294/99.2 X |
| 2,563,422 | A | * | 8/1951 | Sabo | 294/99.2 X |
| 2,634,728 | A | | 4/1953 | Dale | |
| 2,833,239 | A | * | 5/1958 | Larsen | 294/99.2 X |
| D195,635 | S | * | 7/1963 | Moyer | D7/686 |
| 3,291,476 | A | | 12/1966 | Calkin | |
| 3,611,842 | A | * | 10/1971 | Skipper | 294/99.2 |
| D266,640 | S | | 10/1982 | Trombly | |
| 5,007,827 | A | | 4/1991 | DiFranco | |
| 5,584,427 | A | * | 12/1996 | Suaso | 294/99.2 X |

* cited by examiner

*Primary Examiner*—Johnny D. Cherry
(74) *Attorney, Agent, or Firm*—James G. O'Neill

(57) ABSTRACT

Cross-lock tweezers for holding a pearl in a mounting during permanent setting of the pearl in the mounting. The tweezers have a pair of elongated, resilient arms that are secured together at one end, extend along their respective lengths, adjacent to each other, cross over each other, and end in a pair of gripping jaws. One of the gripping jaws is cup-shaped, and includes a contoured inner face, which conforms to a pearl held therein to firmly hold the pearl against a mounting held against the other gripping jaw.

9 Claims, 1 Drawing Sheet

CROSS-LOCK TWEEZERS WITH CUP TO HOLD PEARLS, OR THE LIKE

BACKGROUND OF THE INVENTION

1. Field of the Invention

This invention relates generally to tweezers, and, more particularly, to crosslock tweezers for use in setting pearls, or the like, in mountings.

2. Description of Related Art

As is well known, jewelry is often made by setting beads, pearls and precious stones, or the like, in mountings. The bead, pearl, precious stone, or the like, has to be held in the mounting while a bonding agent, such as a glue or solder, hardens to prevent the bead, pearl, or precious stone from separating from the mounting. When utilizing known tools for holding precious stones to a mounting, the tools are only useful with hard and durable precious stones, such as diamonds. However, when softer beads or pearls are set, the known tools do not adequately hold the beads or pearls to the mounting, either because too much pressure must be applied, or the rounded shape of the bead or pearl may slip within the gripping element, thereby marring or scratching the bead or pearl.

Particularly in the case of pearls, if a holding device is too tight and the pearl slips, marring or deep scratches may be caused to the pearl, thus, causing complete destruction or loss in value of the pearl.

Known tweezers for use in dental or orthopedic work, and for holding jewels, or the like, are set forth in U.S. Pat. No. 1,033,942 to Ruggles, U.S. Pat. No. 1,174,004 to Greenwald, U.S. Pat. No. 1,481,598 to Gatti, U.S. Pat. No. 2,634,728 to Dale, U.S. Pat. No. 3,291,476 to Calkin, and U.S. Pat. No. 5,007,827 to Di Franco. However, these devices are not capable of holding a pearl in a safe and secure manner.

Therefore, there exists a need in the art for a pair of tweezers for use by jewelers when working with pearls and other valuable round items to aid in holding a pearl in position in a mounting or setting to allow the pearl and mounting or setting to be permanently held together.

The present invention provides for a pair of tweezers having a cup-shaped gripping element, which conforms to the shape of a rounded element, such as a pearl, to securely hold the pearl in position in a mounting, without scratching or marring the same. The cup-shaped gripping element is smooth, but provides sufficient force or pressure against the pearl, to prevent the pearl from being pushed out, or slipping from a mounting or setting.

SUMMARY OF THE INVENTION

Accordingly, it is a general object of the present invention to provide an improved jewel holding device. It is a particular object of the present invention to provide an improved pair of tweezers for holding a pearl, or the like, during setting.

It is another particular object of the present invention to provide an improved pair of cross-lock tweezers having a specifically shaped gripping cup formed at one end for securely holding a bead, pearl, or the like. It is yet another particular object of the present invention to provide improved cross-lock tweezers having a cup-shaped gripping element, which is rounded and smooth so as to securely and firmly hold a pearl against a mounting during the setting thereof, while providing sufficient force, without scratching or marring the pearl. And, it is yet a still further particular object of the present invention to provide an improved pair of pearl-holding tweezers of the cross-over type having gripper jaws at one end, with the gripper jaws formed as a straight holding portion and a cup-shaped holding portion for securely holding a pearl, or the like, in position, without scratching the surface of the pearl.

The present invention comprises tweezers having a pair of arms held together at first ends with gripping jaws formed at second ends. The gripping jaws are composed of a straight portion, and an opposed cup-shaped portion having a rounded inner surface so as to firmly and securely grip a pearl, or the like, during setting in a mounting, without marring or scratching the surface.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figures 1, 2, 3, 4:
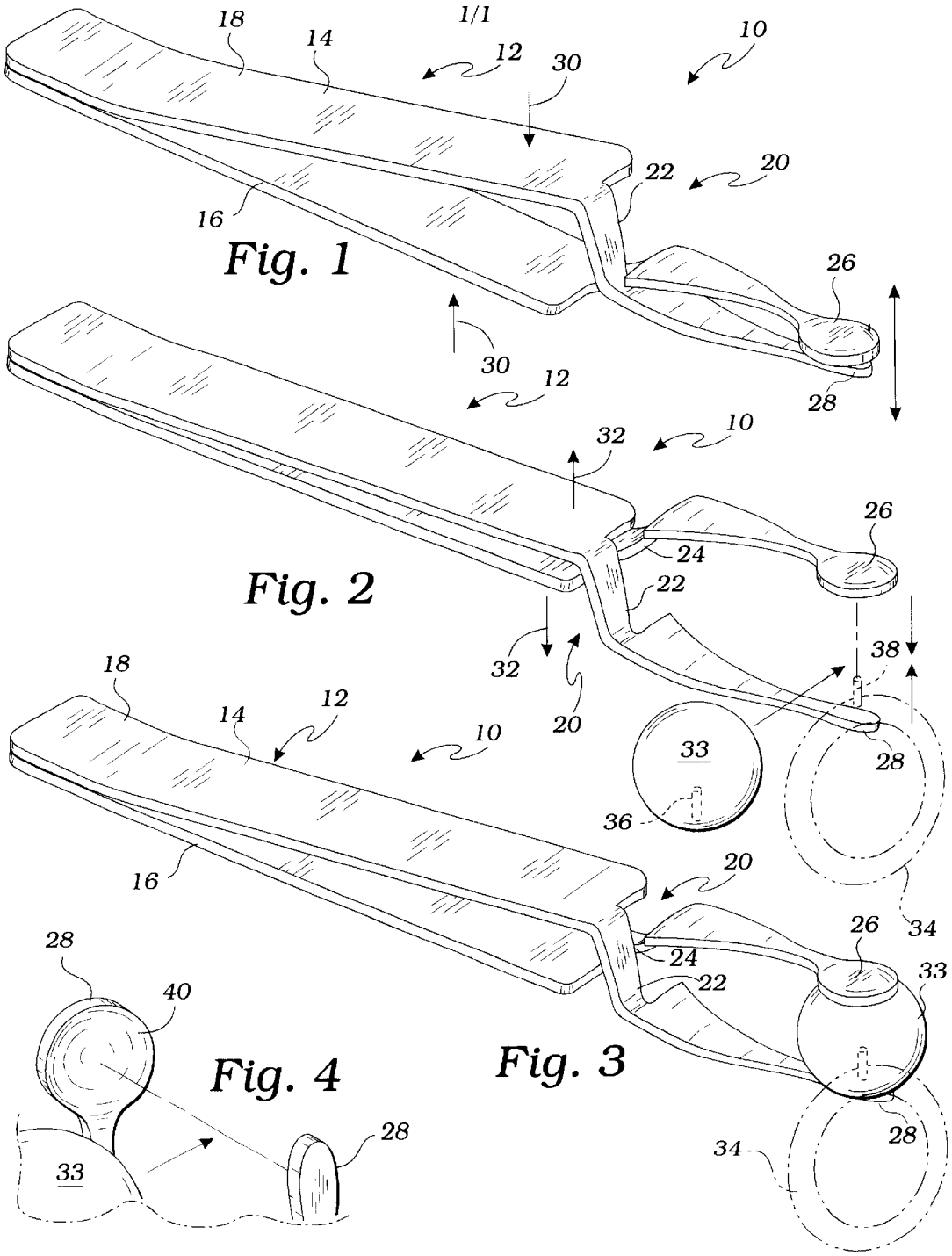
FIG. 1 is a perspective view of a currently preferred embodiment of cross-lock tweezers in accordance with the present invention.
FIG. 2 is a perspective view similar to FIG. 1, with cross-lock gripping jaws in the open position to allow a pearl, or the like, to be inserted and held to a mounting supported therein.
FIG. 3 is a perspective view of the cross-lock tweezers of FIG. 1, with a pearl securely held to a mounting between the gripping jaws.
FIG. 4 is an enlarged partial perspective view of the gripping jaws of the tweezers of the present invention, in the open position.

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to provide for improved tweezers for holding a pearl, or the like, to a mounting or setting, generally indicated at 10.

Although the present invention may be used with many types of rounded objects, such as valuable beads, or stones, it is particularly useful with pearls. Pearls may be set in mountings or settings, such as bracelets, broaches, earrings, necklaces, pendants, rings, etc. Additionally, valuable beads may be mounted or set in custom or costume jewelry. In order to set pearls, the currently preferred method of doing so is as follows:

1) a hole is first drilled in the pearl to be set;
2) the pearl is then examined so that it may be positioned with its best side or surface showing when it is held in the mounting or setting;
3) when the best side of the pearl has been determined, a mark is placed on the pearl and the mounting or setting to align the same for securing them together. It is customary in the trade to prepare 20–30 pearls and their mountings at the same time;
4) the prepared pearls and mountings are brought together, and then bonded or glued together; and 5) the bonded or glued together pearls and mountings must be tightly held in position for a sufficient period of time for the glue to harden and the pearl and mounting safely and securely set.

The presently preferred glue to use for setting pearls in mountings is a two-component epoxy glue which dries slowly. This makes the epoxy glue easy to work with, and it is also very durable. When using such epoxy glue, the pearl and mounting must be tightly held together for approximately five minutes, to avoid separation of the pearl and mounting, for any reason, for example, because of the pressure of any air that might remain inside a hole formed in the pearl.

Additionally, fast-drying glues, such as Superglue® might be used. However, these glues make it very difficult to properly position the pearl on the mounting or setting. Additionally, such fast-drying glues are quite brittle. Moreover, since 20–30 pearls and mountings or settings are prepared and preferably worked on at the same time to be productive, a fast-drying glue would present problems. Since no known tool can be used to safely hold pearls and mountings together during setting of the pearl, without the danger of marring or scratching the pearls, many jewelers must resort to jury-rigged devices, such as plastic clothespins to hold the pearl and mounting or setting together. Obviously, these plastic clothespins lack the necessary precision to securely hold pearls in place during setting, and do not always produce acceptable results.

Therefore, the tweezers 10 of the present invention were designed and have proven to be extremely useful in holding pearls and mountings or settings together during drying of a holding glue. The terms "mounting" and "setting" are used interchangeably to refer to the jewelry element or portion in which a valuable pearl is inserted and held. The tweezers 10 include a body 12 having a pair of generally flat, elongated, resilient arms or members 14, 16, secured together at first ends 18. The arms 14, 16 extend outwardly from the secured-together ends at 18 at an angle to each other so that they are spaced apart, as most clearly shown in FIG. 1. The arms 14, 16 may be made from any durable, strong, resilient material, such as plastic, spring steel, or the like. The arms are formed and shaped as shown in FIGS. 1–3, so that they cross over each other at cross-over portion or position 20. At this cross-over portion or position 20, each of the arms 14, 16 is provided with a notch 22, 24 to allow the arms 14, 16 to be pinched or brought together, against the resilient bias of the arms, to open gripping ends or jaws 26, 28 at outer or second ends of the arms 14, 16.

The gripping ends or jaws 26, 28 are comprised of a first substantially spoon-shaped or cupped-shaped end or jaw 26, and a second substantially narrow straight end or jaw 28.

As shown in FIGS. 1 and 2, when a force is applied to the arms 14, 16, in the direction of the arrows 30, as by pressing thereon by the fingers of a user, the arms 14, 16 will be brought together (FIG. 2), and the gripping ends 26 and 28 spread apart. Upon release of the force on the arms 14 and 16, they will move outwardly, in the direction of the arrows 32 (FIG. 2), so that the gripping ends 26, 28 will be brought back to their closed position (FIG. 1).

Turning now to FIGS. 2–4, the preferred use of the present tweezers to set oval or rounded objects, such as pearls, in mountings will now be described. Pearls are preferably set in their mountings with a bonding agent or glue, as described above, and then inserted between the open jaws of the tweezers 10 of the present invention. In that position, a smooth, concave, contoured, or curved inner surface 40 (see FIG. 4) of the first cup-shaped end 26 contacts a pearl 33, and the second gripping end 28 contacts a mounting or setting 34, such as a ring. It is to be understood that the mounting 34 and pearl 33 to be held and set in the tweezers 10 of the present invention are normally put together prior to being inserted in the tweezers 10. However, for illustrative purposed only, FIG. 2 shows the pearl 33, having a predrilled hole 36 therein, before it is mounted on a pin 38 secured to the mounting 34. Glue, or another bonding agent, is applied around pin 38 and/or in the hole 36, and the pin 38 inserted in hole 36, with the pearl on the mounting. The assembled pearl 33 and mounting 34 are then inserted between the open jaws 26, 28, with the pearl 33 directed toward the smooth, concave inner surface 40 of cup-shaped end 26, and the mounting 34 directed toward the substantially narrow, straight gripping end 28. The tweezers 10 are sized and dimensioned to securely hold the pearl 33 and mounting 34 fly or tightly together, without marring or scratching the pearl until the bonding agent is dry. The material from which the arms 14 and 16 are made must be sufficiently strong and have sufficient resiliency to allow the arms to be opened and then close automatically. When closed with a pearl and mounting therein, the gripping ends 26, 28 of the arms must fly and tightly hold a pearl and mounting together during drying of the glue to allow the pearl to be properly set in the mounting. Furthermore, the smooth curved inner surface 40 of the cup-shaped jaw 26 should be without any bumps, burrs or protrusions, and sized and shaped to conform to substantially any size pearl held therein, without marring or scratching the surface of the pearl. If desired, either or both jaws may be coated with a soft plastic or silicone to further protect items held therein.

It therefore, can be seen that the tweezers of the present invention provide an improved means for firmly and tightly holding pearls and other oval or rounded items to a mounting, during setting. The tweezers allow proper drying of a glue, without marring or scratching any pearl and mounting held therein, while ensuring that the pearl is permanently set in its mounting, in an expeditious, safe and secure manner, with a minimum of effort.

Those skilled in the art will appreciate that there are adaptations and modifications of the just-described preferred embodiments that can be configured without departing from the scope and spirit of the invention. Therefore, it is to be understood, that within the scope of the intended claims, the invention may be practiced other than is specifically described herein.

What is claimed is:

1. Cross-lock tweezers for securing a pearl or bead to a setting, comprising:

the setting having a protruding portion;

the pearl or bead having an opening formed therein for placement over the protruding portion;

a bonding agent for permanently securing the pearl or bead to the setting;

the cross-lock tweezers having a pair of generally flat, elongated, resilient arms secured together at first ends with a pair of gripping elements at second ends; the pair of generally flat, elongated, resilient arms crossing over one another between the first ends and the second ends;

a first of the pair of gripping elements formed as a cup-shaped jaw for firmly holding the pearl or bead to the setting, during drying of the bonding agent, without marring or scratching the pearl or bead; and a second of the pair of gripping elements formed as a single substantially narrow, straight end for firmly holding the setting against the pearl or bead during drying of the bonding agent.

2. The cross-lock tweezers of claim 1 wherein the cup-shaped jaw includes a smooth, concave inner surface to closely conform to an outer surface of the pearl or bead during drying of the bonding agent.

3. The cross-lock tweezers of claim 2 wherein the protruding portion on the setting is a pin, and the pin is held in the opening in the pearl or bead by the bonding agent.

4. The cross-lock tweezers of claim 3 wherein the pair of generally flat elongated, resilient arms are made of metal.

5. The cross-lock tweezers of claim 3 wherein the pair of generally flat elongated, resilient arms are made of plastic.

6. The cross-lock tweezers of claim 3 wherein at least the cup-shaped jaw is coated with a covering selected from the group consisting of plastic and silicone.

7. Cross-lock tweezers for securing a pearl or bead to a setting comprising:

the setting having a protruding pin;

the pearl or bead having an opening formed therein for placement over the protruding pin;

a bonding agent for permanently securing the pearl or bead to the protruding pin;

the tweezers being made from metal and having a pair of generally flat, elongated, resilient arms secured together at first ends with a pair of opposed gripping elements at second ends; the pair of generally flat, elongated, resilient arms crossing over one another between the first ends and the second ends;

a first of the pair of gripping elements having a smooth, concave inner surface to closely conform to and firmly hold an outer surface of the pearl or bead to the pin on the setting during drying of the bonding agent, without marring or scratching the pearl or bead; and a second of the pair of gripping elements formed as a single, substantially narrow, straight finger for firmly holding the setting against the pearl or bead during drying of the bonding agent.

8. The cross-lock tweezers of claim 7 wherein at least the cup-shaped element is coated with a covering selected from the group consisting of plastic and silicone.

9. Cross-lock tweezers for securing a pearl or bead to a setting comprising:

the setting having a protruding pin;

the pearl or bead having an opening formed therein for placement over the protruding pin;

a bonding agent for permanently securing the pearl or bead to the protruding pin;

the tweezers being made from plastic and having a pair of generally flat, elongated, resilient arms secured together at first ends with a pair of opposed gripping elements at second ends; the pair of generally flat, elongated, resilient arms crossing over one another between the first ends and the second ends;

a first of the pair of gripping elements having a smooth, concave inner surface to closely conform to and firmly hold an outer surface of the pearl or bead to the pin on the setting during drying of the bonding agent, without marring of scratching the pearl or bead; and a second of the pair of gripping elements formed as a single, substantially narrow, straight finger for firmly holding the setting against the pearl or bead during drying of the bonding agent.

* * * * *